US009850638B2

(12) United States Patent
Despotellis

(10) Patent No.: US 9,850,638 B2
(45) Date of Patent: Dec. 26, 2017

(54) FOOTING PLATES

(76) Inventor: Neil Despotellis, Bundoora (AU)

( * ) Notice: Subject to any disclaimer, the term of this patent is extended or adjusted under 35 U.S.C. 154(b) by 0 days.

(21) Appl. No.: 14/126,935

(22) PCT Filed: Jun. 28, 2012

(86) PCT No.: PCT/AU2012/000760
§ 371 (c)(1),
(2), (4) Date: Dec. 17, 2013

(87) PCT Pub. No.: WO2013/000022
PCT Pub. Date: Jan. 3, 2013

(65) Prior Publication Data

US 2014/0174003 A1 Jun. 26, 2014

(30) Foreign Application Priority Data

Jun. 28, 2011 (AU) ..... 2011902537

(51) Int. Cl.
*E02D 27/42* (2006.01)
*E04H 12/22* (2006.01)
*E02D 5/80* (2006.01)
*E02D 31/00* (2006.01)

(52) U.S. Cl.
CPC ..... *E02D 27/42* (2013.01); *E02D 5/80* (2013.01); *E02D 31/002* (2013.01); *E04H 12/223* (2013.01)

(58) Field of Classification Search
CPC ..... E02D 27/42; E02D 5/80; E02D 27/50; E02D 31/002; E04H 12/223
USPC ..... 52/169.3, 155, 156, 157, 158, 159
See application file for complete search history.

(56) References Cited

U.S. PATENT DOCUMENTS

| | | | | | |
|---|---|---|---|---|---|
| 373,621 | A | * | 11/1887 | Turnberger | 52/156 |
| 823,441 | A | * | 6/1906 | Robinson | 256/35 |
| 2,870,884 | A | * | 1/1959 | Mazur | 52/158 |
| 3,591,113 | A | * | 7/1971 | Foster, Jr. | 248/519 |
| 3,775,918 | A | * | 12/1973 | Johnson | 52/155 |
| 4,189,125 | A | * | 2/1980 | Little | 248/346.02 |
| 4,452,018 | A | * | 6/1984 | Hill | 52/155 |
| 5,039,256 | A | * | 8/1991 | Gagliano | 405/244 |

(Continued)

FOREIGN PATENT DOCUMENTS

| | | | |
|---|---|---|---|
| DE | 823336 | C | 11/1952 |
| DE | 102009037175 | A1 | 2/2011 |

(Continued)

OTHER PUBLICATIONS

Machine Translation of DE 10 2009 037175, Generated Jul. 2014.*

*Primary Examiner* — Brent W Herring
(74) *Attorney, Agent, or Firm* — Dowell & Dowell, PC

(57) ABSTRACT

A footing plate (10) including a planar web (12) through or from which a plurality of tubes (14) pass, the tubes (14) being adjacent to the edges of the planar web (12) and being disposed at angles to the planar web (12), none of the angles being 90°, the tubes (14) being sized to permit the passage therethrough of pins (18) for fixing into underlying ground, the upper face of the planar web (12) optionally being provided with a plurality of holes to accept bolts for retaining means to receiving a post, pole or upright structural beam, the planar web (12) also being provided with a downwardly extending flange (16) from at least one of the edges of the planar web (12).

8 Claims, 15 Drawing Sheets

(56) References Cited

U.S. PATENT DOCUMENTS

| | | | | | |
|---|---|---|---|---|---|
| 5,065,975 | A * | 11/1991 | Giles | E04H 12/223 | 232/39 |
| 5,515,656 | A * | 5/1996 | Mihalich | 52/155 | |
| 5,873,679 | A * | 2/1999 | Cusimano | 405/231 | |
| 6,591,564 | B2 * | 7/2003 | Cusimano | 52/274 | |
| 6,910,832 | B2 * | 6/2005 | Gagliano et al. | 405/231 | |
| 7,076,925 | B2 * | 7/2006 | Gagliano | 52/155 | |
| 7,326,003 | B2 * | 2/2008 | Gagliano | 405/229 | |
| 8,561,361 | B2 * | 10/2013 | Bauletti | 52/155 | |
| 8,714,881 | B2 * | 5/2014 | Gagliano | 405/231 | |
| 2007/0158526 | A1 * | 7/2007 | Platt | E04H 12/2261 | 248/519 |
| 2010/0307073 | A1 * | 12/2010 | Oliver et al. | 52/169.9 | |

FOREIGN PATENT DOCUMENTS

| | | | | |
|---|---|---|---|---|
| EP | 2360331 | A1 * | 8/2011 | E04H 12/22 |
| FR | 2829777 | A1 * | 3/2003 | E02D 27/42 |
| WO | 2010119432 | A2 | 10/2010 | |

* cited by examiner

FOOTING PLATES

FIELD OF THE INVENTION

This invention relates to the provision of footings for posts or beams in buildings and structures. In particular this invention relates to improved footing plates for posts, poles or upright beams in buildings and similar structures.

BACKGROUND OF THE INVENTION

Posts and poles are commonly used integers in buildings and similar structures. However, depending on the size and/or purpose of the building or structure, significant amounts of labour and materials are required to provide secure footings for the posts or poles. One approach is to dig excessively large holes, place the lower ends of the posts or poles in the holes and fill the holes with concrete or cement. Another approach is to dig large holes, fill them with concrete or cement, insert bolts into the concrete or cement, and then retain footing plates on the bolts. These approaches are time consuming and costly. Swelling and/or contraction of the concrete or cement can occur, necessitating further time and cost to correctly secure the footing. It is an aim of the present invention to at least ameliorate these problems.

SUMMARY OF THE INVENTION

According to one aspect of the present invention there is provided a footing plate including a planar web through which a plurality of tubes pass, said tubes being adjacent the edges of the planar web, optionally offset from the edges of the planar web, and being disposed at angles to the planar web, none of said angles being 90°, said tubes being sized to permit the passage therethrough of pins for fixing thereof into underlying ground, said upper face of the planar web optionally being provided with a plurality of holes to accept bolts for retaining means for receiving a post, pole or upright structural beam, the planar web being provided with a downwardly extending flange on at least one of the edges of the planar web. Preferably, a downwardly extending flange is provided on each edge of said planar web. The downwardly extending flange or flanges preferably also extend outwardly of said planar web.

According to another aspect of the present invention there is provided a footing plate including a planar web from which a plurality of tubes originate and descend, said tubes being adjacent the edges of the planar web, optionally offset from the edges of the planar web, and being disposed at angles to the planar web, none of said angles being 90°, said tubes being sized to permit the passage therethrough of pins for fixing thereof into underlying ground, said upper face of the planar web optionally being provided with a plurality of holes to accept bolts for retaining means for receiving a post, pole or upright structural beam, the planar web being provided with a downwardly extending flange on at least one of the edges of the planar web. Preferably, a downwardly extending flange is provided on each edge of the planar web. The downwardly extending flange or flanges preferably also extend outwardly of the planar web.

The said downwardly extending flange or flanges may be formed by bending the planar web adjacent its edges or by welding of the flanges to the edges of the planar web. Alternatively, the flange or flanges and planar web may be cast or moulded as one piece. The provision of flanges stiffens the planar web to minimize bending or warping thereof. It will be appreciated that the planar web and flanges will be of sufficient thickness to permit the footing plate to be usefully employed in supporting the retaining means for receiving a post, pole or upright structural beam without being distorted appreciably.

Optionally, the footing plate may be provided on the underside of the planar web with at least one rib for strengthening the planar web. Preferably, the underside of the planar web is provided with a plurality of such reinforcing ribs which may be welded to the underside and to at least one of the said flanges extending downwardly from at least one of the edges of the planar web. Alternatively, the at least one rib for strengthening the planar web or plurality of such reinforcing ribs may be cast or moulded along with the planar web and flange or flanges as one piece.

More preferably, said plurality of reinforcing ribs meet and are joined to provide further strengthening for the planar web.

Preferably, the said flanges and reinforcing ribs extend to a distance below the planar web that permits the unimpeded passage of pins through the tubes provided in the web into the underlying ground.

The planar web may have the outline of a circle, oval or ellipse or a square, rectangle, rhombus, trapezium, parallelogram, triangle or other polygon. For ease of use a square outline is preferred.

The means for receiving a post, pole or upright structural beam may include a socket which has a cross-section which is either circular, square, rectangular, triangular, hexagonal or prismatic. The dimensions of the socket are usually such as to accommodate one of the known cross-sectional dimensions of a post, pole or structural beam, although specifically dimensioned sockets can be fabricated and used with the footing plate of the invention, so long as the socket can be mounted securely on the footing plate, usually by means of bolts passing through registering holes in the planar web and a plate fixed to the lower end of the socket. The bolts may be welded in position if desired.

In use a socket may be secured to a footing plate according to the present invention. The footing plate is then placed on the ground, preferably leveled off, at the required point. Alternatively the footing plate is placed in a depression in the ground formed by scrapping out dirt to the extent required to have the top face of the planar web of the footing plate level with or slightly lower than the surrounding ground. Pins are then inserted into the plurality of tubes passing through the planar web and hammered or jackhammered into the underlying ground until the top ends of the pins are almost level with the top ends of the respective tubes. The length of the pins is such that they are securely fastened in the underlying ground. The "splaying" of the pins in the underlying ground provides a stable and strong anchorage for the footing plate. A post or pole may then be inserted in the socket.

The present invention provides a relatively quicker and more cost effective way to erect posts or poles of any reasonable given size without the need to excavate large holes and use considerable quantities of cement or concrete.

The footing plate can be made out of any suitable materials. Steel is a preferred material. However, there may be instances in which other materials, such as aluminium or suitably stable plastics, may be used successfully. As mentioned previously the footing plate may be fabricated by welding components together or may be fabricated in one piece by casting or moulding or similar means.

PREFERRED EMBODIMENTS

In order that the invention may be more clearly understood some preferred embodiments are hereinafter described with reference to the accompanying drawings in which.

DESCRIPTION OF PREFERRED EMBODIMENTS

Figure 1:
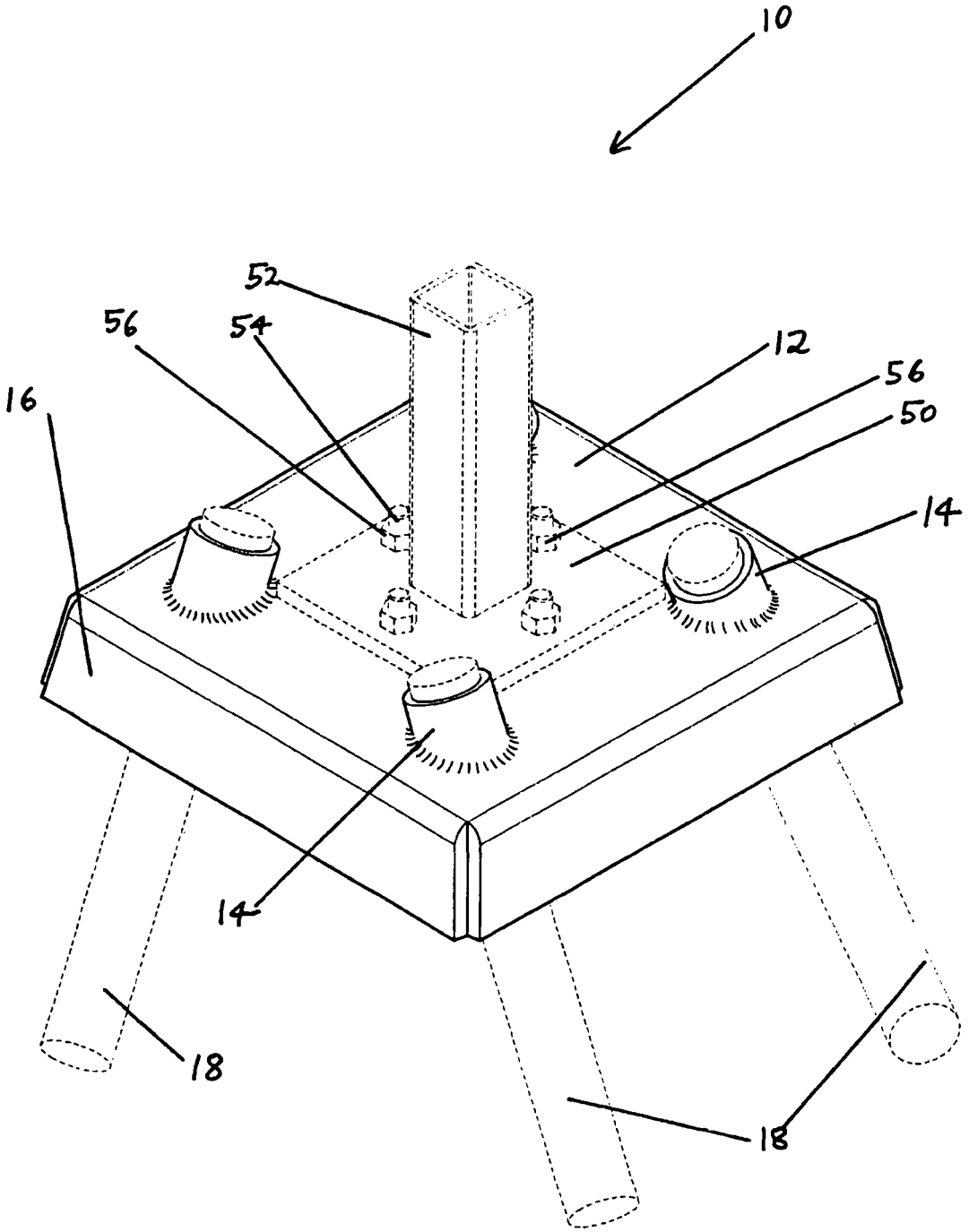
FIG. 1 is a perspective view of a first preferred embodiment with a socket (in phantom) secured thereto and pins (in phantom)
Figure 2:
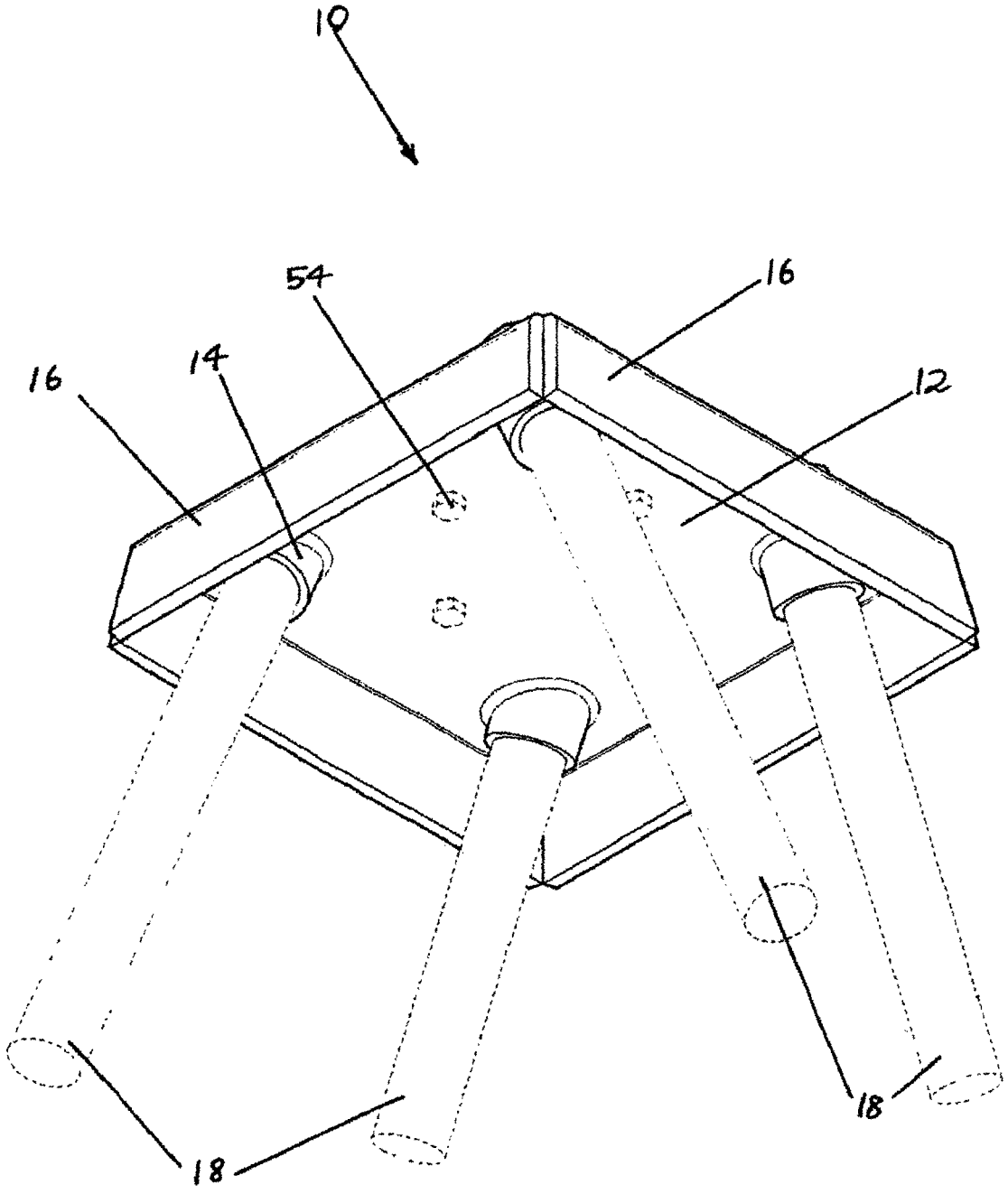
FIG. 2 is an underneath perspective view of the embodiment of FIG. 1.
Figure 3:
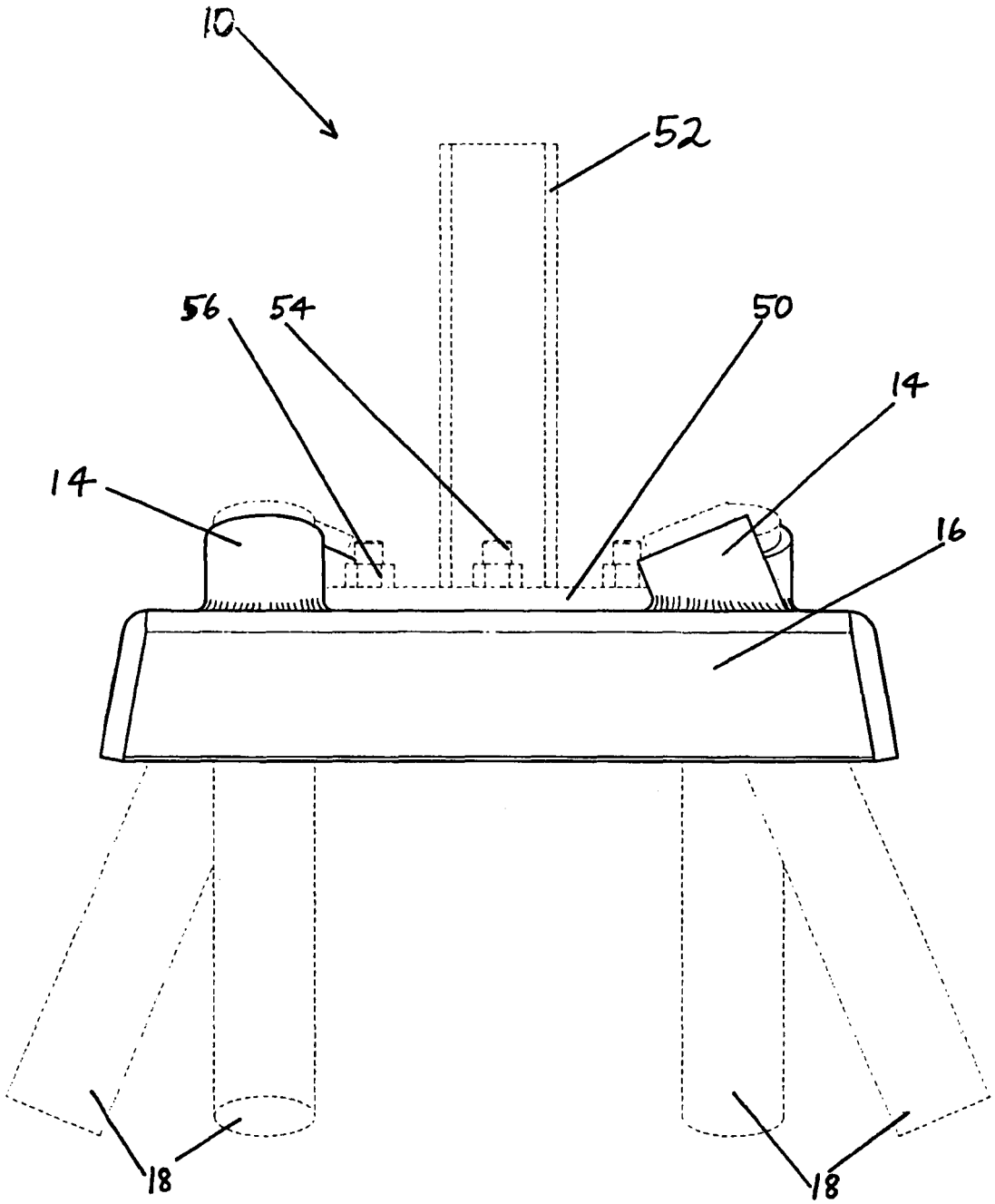
FIG. 3 is an elevational view of the embodiment of FIG. 1.
Figure 4:
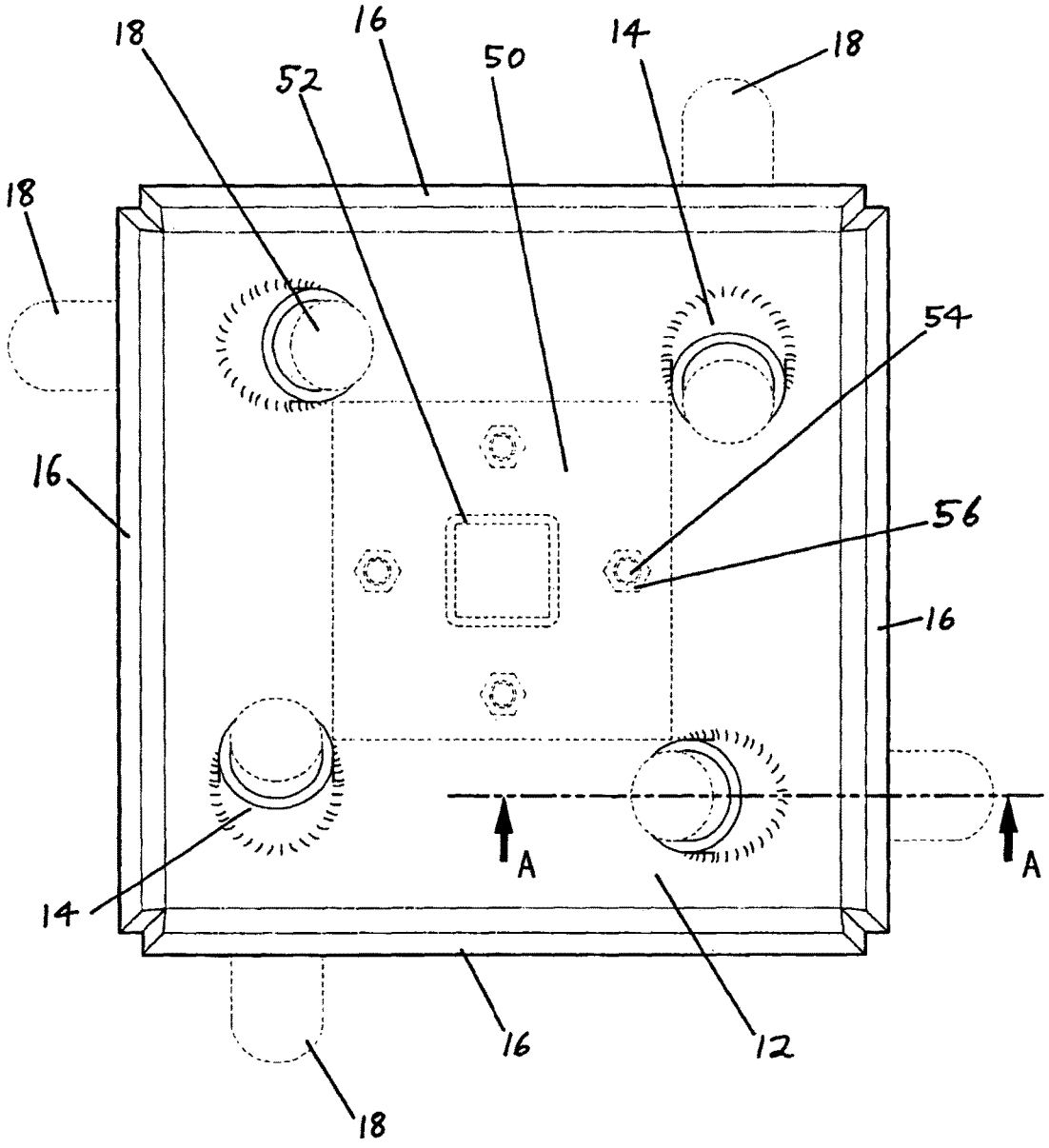
FIG. 4 is a plan view from above of the embodiment of FIG. 1.

In FIGS. 1 to 10 the numerals 10 and 40, respectively, denote generally footing plates being the first and second preferred embodiments, respectively, of the present invention. Throughout the drawings the numerals 12 and 42, respectively, denote the planar webs of the first and second preferred embodiments, respectfully, and the numerals 14 and 44, respectively, denote the tubes passing through planar webs 12 and 42, respectively. The numerals 16 and 46, respectively, denote flanges extending downwardly from the edges of planar webs 12 and 42, respectively. The flanges (16, 46) typically are formed by cutting corners of the planar web and folding down portions of the planar web (12, 42) at an angle so as to not impede the passage of pins, 18 (in phantom), 48 (in phantom), respectively, through tubes 14 or 44, respectively, into the underlying ground on which the footing plate is placed in use.

Each of the planar webs 12, 42 is provided with holes in registration with holes in the base plate 50 of a means for receiving a post or pole, which means consists of a socket 52 permanently secured to the base plate 50, preferably by welding. Bolts 54 and nuts 56 secure the base plate 50 to the planar web 12 or 42.

Figure 5:
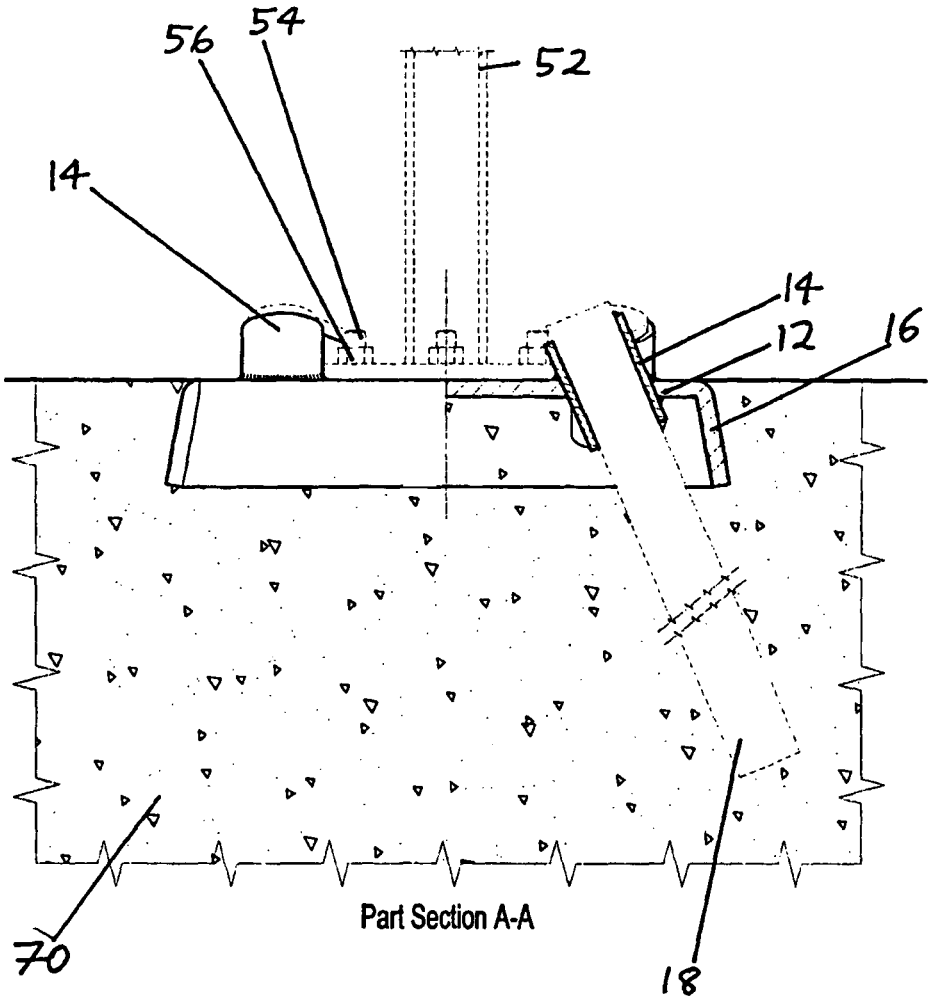
FIG. 5 is a partial sectional view along line A-A of FIG. 4 (showing the first embodiment in use)
Figure 6:
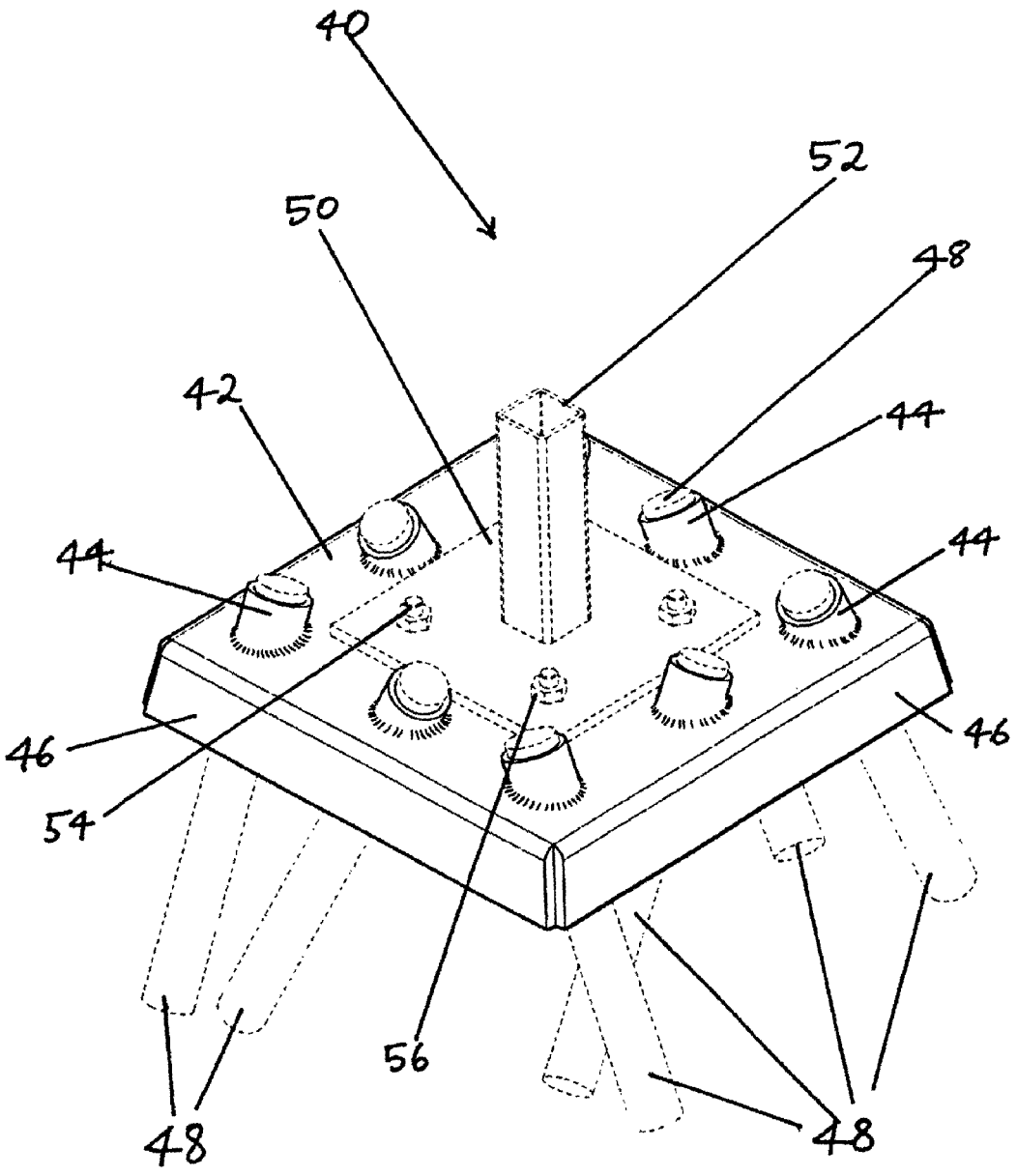
FIG. 6 is a perspective view of a second preferred embodiment showing a socket and pins in phantom.

In use a support plate 50 and socket 52 are secured to the planar web 12 or 42 by bolts 54 and nuts 56 just prior to placing the footing plate 10 or 40 in position on leveled ground. For ease of transportation the support plate 50 and socket 52 are separated from the footing plate. Pins 18 or 48 are then driven through tubes 14, 44 into the underlying ground 70 until the top ends of the pins (18, 48) are close to level with the tops of the tubes (14, 44). A jackhammer may be used to achieve this relatively quickly. FIG. 5 shows how one such pin 18 can be used as part of the anchoring of foot plate 10 to the ground. The "splaying" of the pin 18 leads to a stable and securely anchored footing plate. The pins (18, 48) typically are of such a length that they are securely engaged with the ground into which they are driven.

Figure 7:
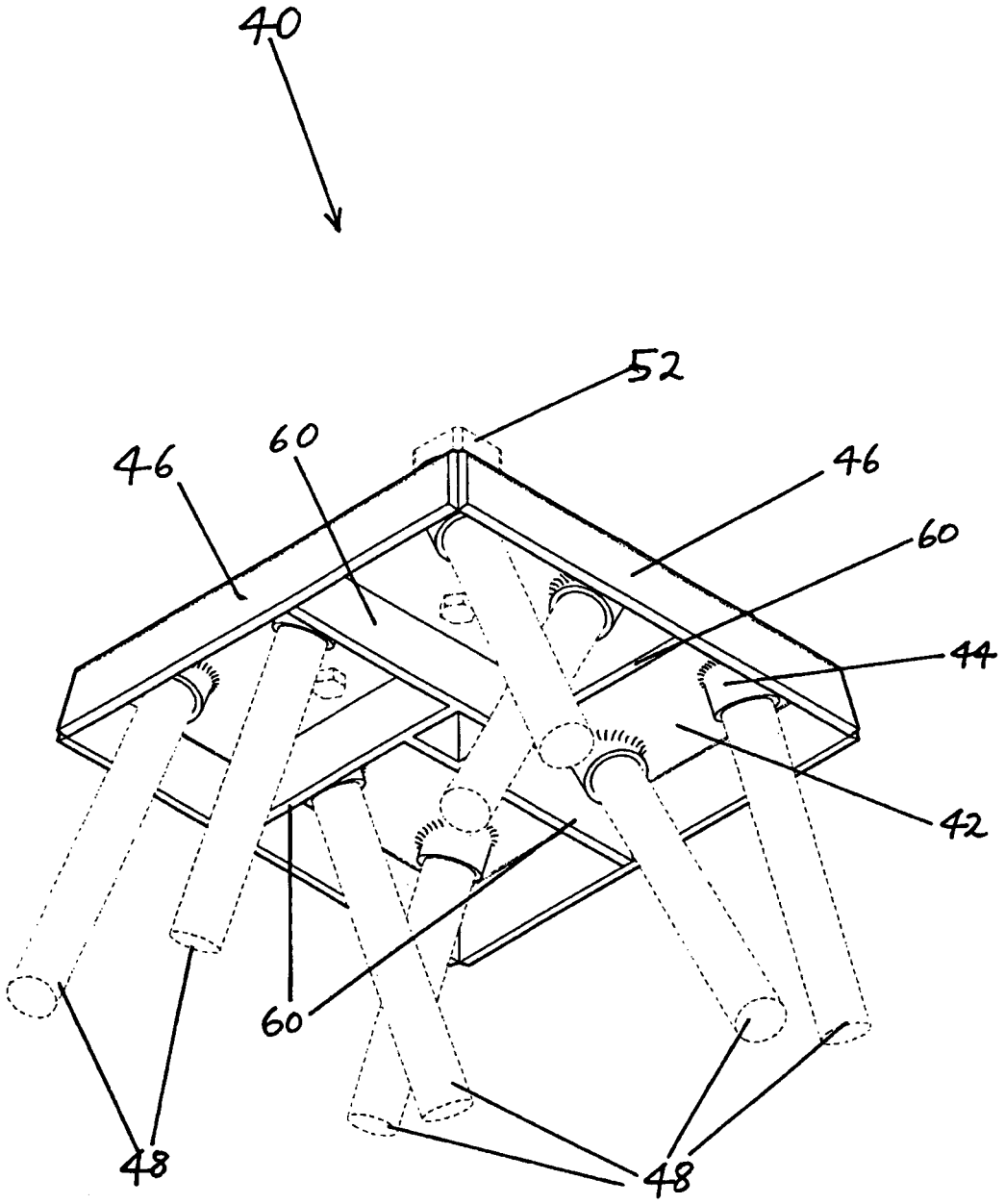
FIG. 7 is an underneath perspective view of the embodiment of FIG. 6.
Figure 8:
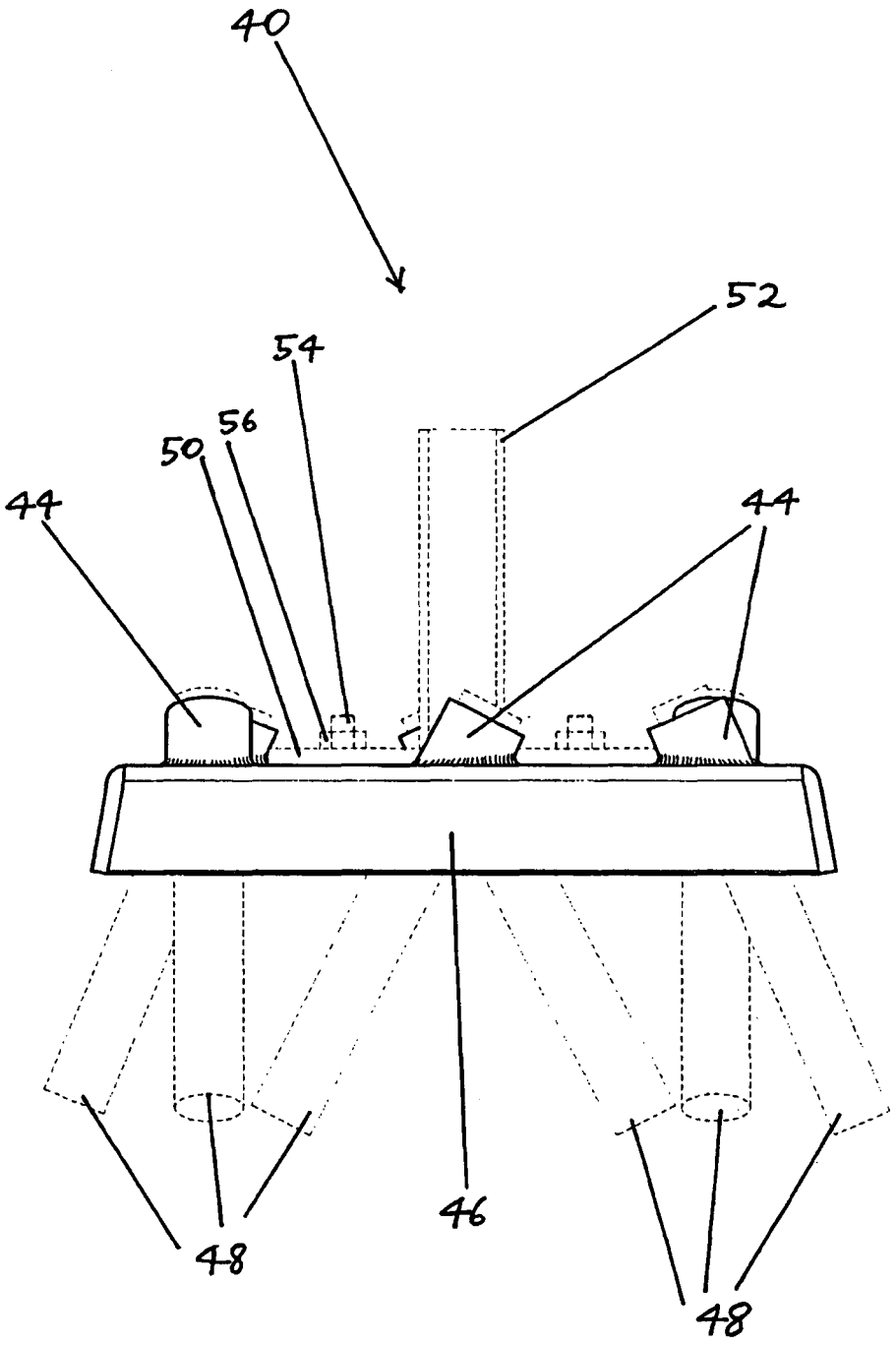
FIG. 8 is an elevational view of the embodiment of FIG. 6.
Figure 9:
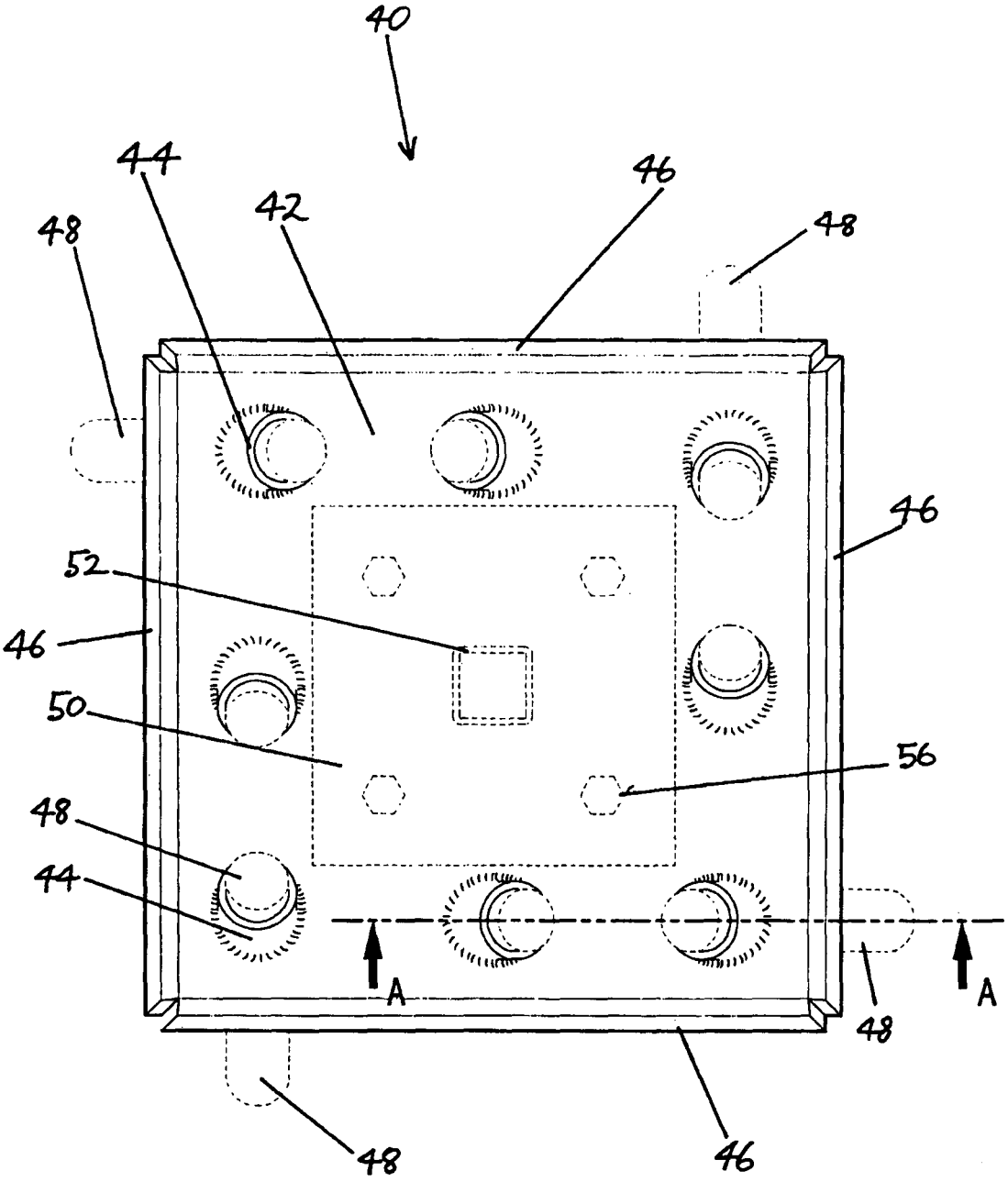
FIG. 9 is a plan view from above of the embodiment of FIG. 6.
Figure 10:
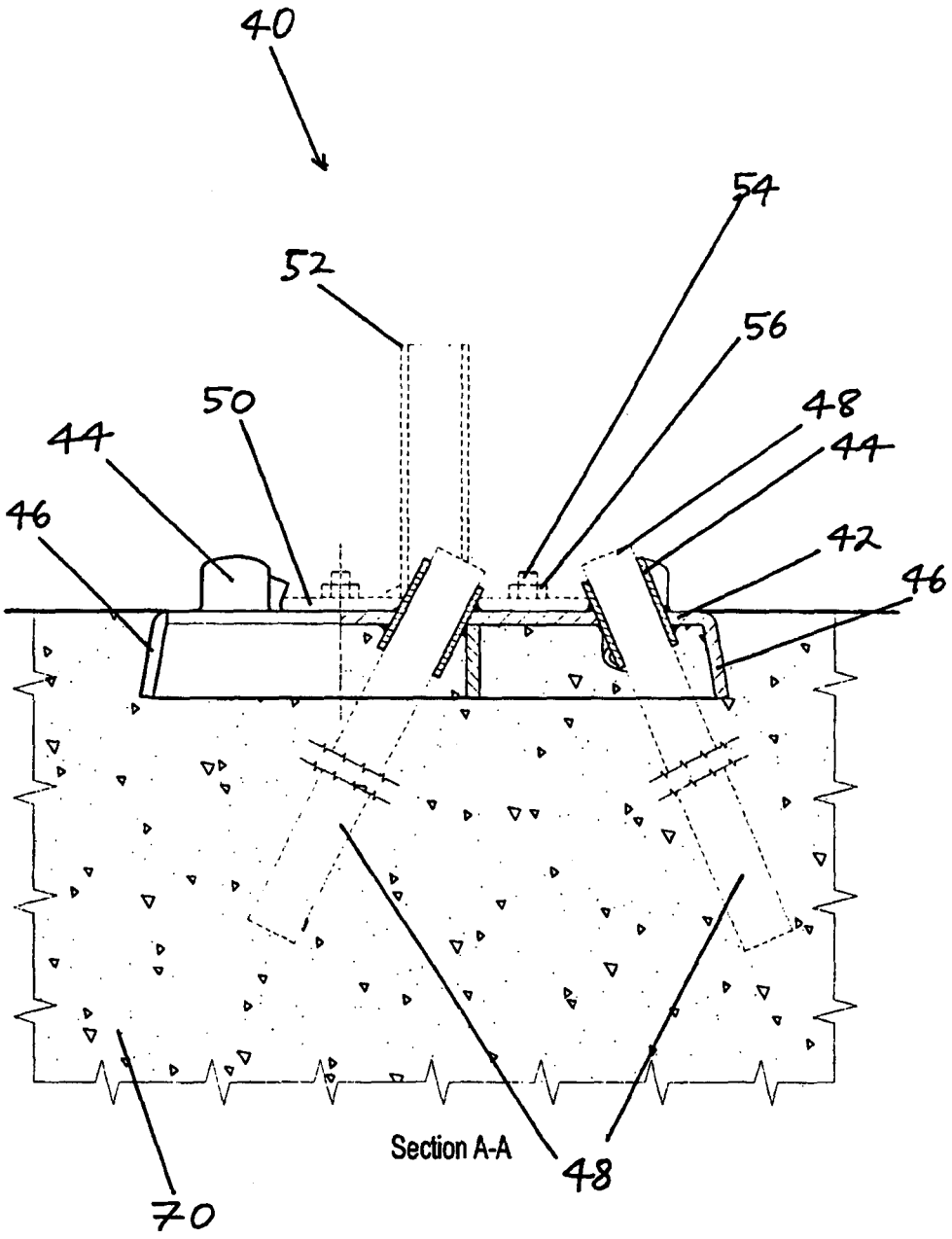
FIG. 10 is a sectional view along line A-A of FIG. 9.
Figure 11:
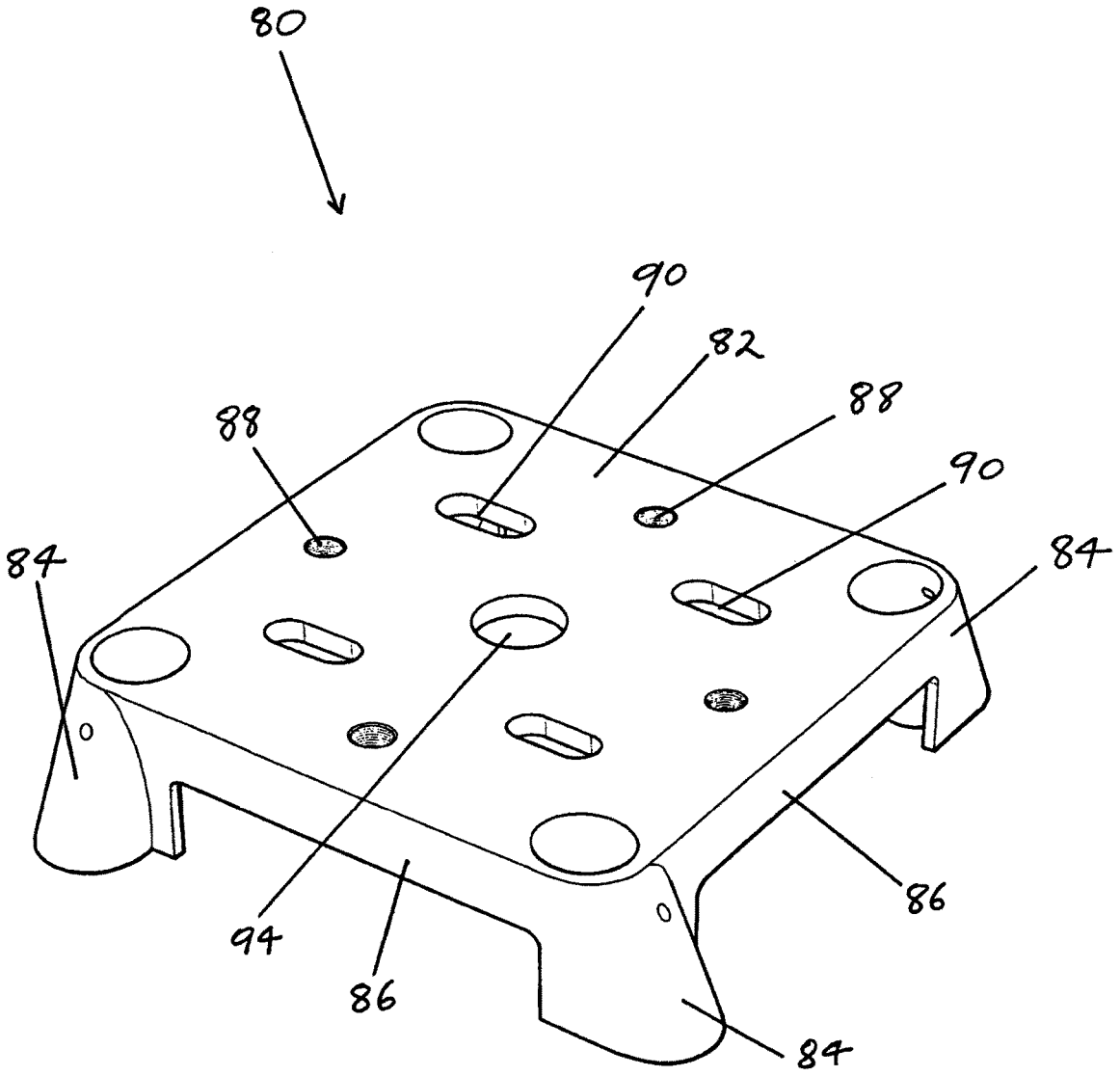
FIG. 11 is a perspective view of a third preferred embodiment of the present invention.
Figure 12:
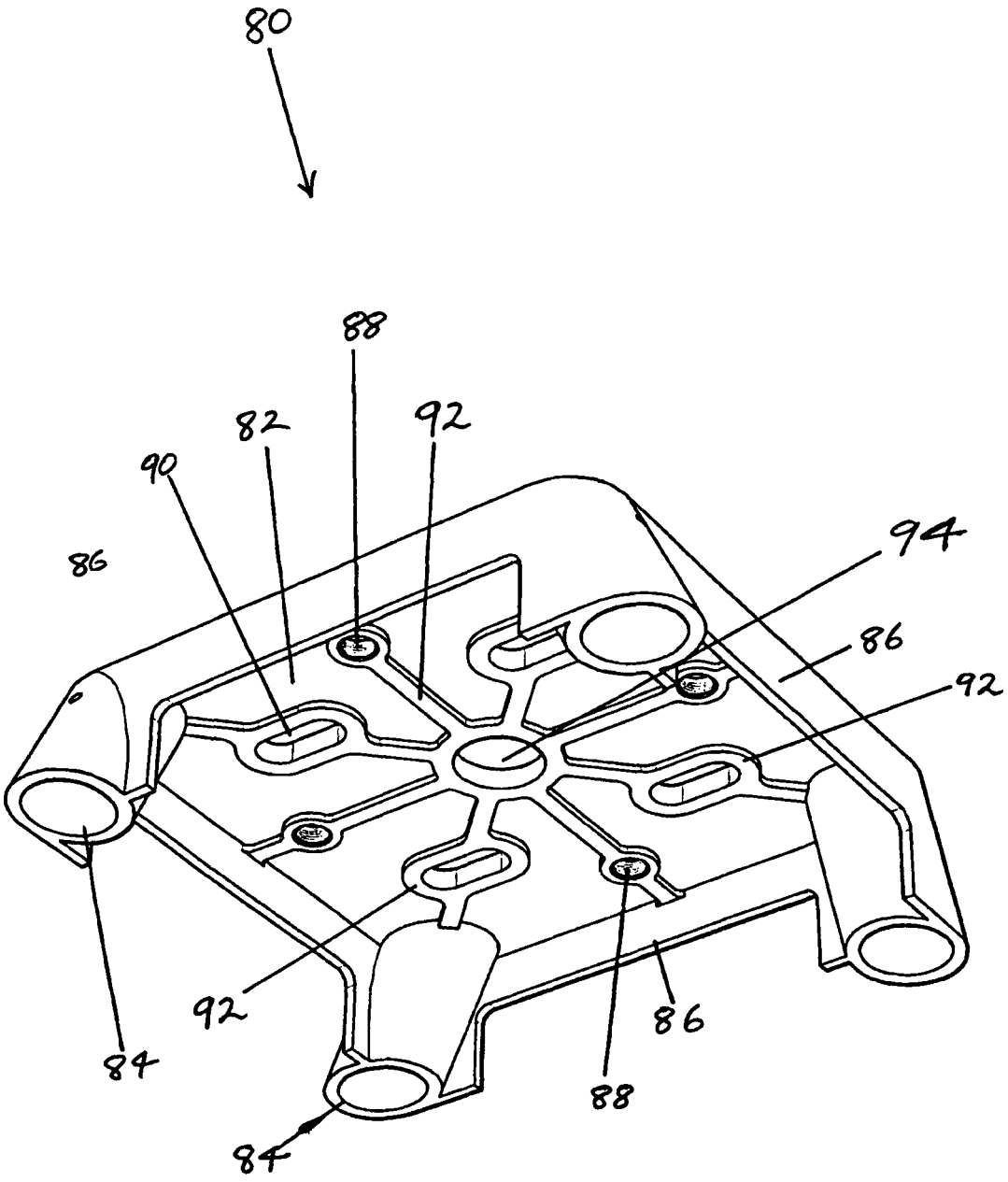
FIG. 12 is an underneath perspective view of the embodiment of FIG. 11.

In the second embodiment 40 a plurality of reinforcing ribs 60 are fixed to the underside of the planar web 42. The reinforcing ribs 60 extend from the inner side of the flange 46 across the underside of the planar web 42 until they meet a reinforcing rib 60 extending transversely. Preferably, the intersection or meeting of the reinforcing ribs is as shown in FIG. 7. The use of such reinforcing ribs 60 enable the use of a lighter weight planar web. FIG. 10 shows how a plurality of pins 48 typically are "splayed" to provide a stable and secure anchorage for the footing plate.

In FIGS. 11 to 15 the numeral 80 denotes generally a footing plate in a third preferred embodiment. Throughout FIGS. 11 to 15, the numeral 82 denotes the planar web, the numeral 84 denotes tubes originating in planar web 82 and extending downwardly therefrom, and the numeral 86 denotes flanges extending downwardly from the edges of planar web 82. In this embodiment the tubes and flanges and planar web may be cast as one piece. The numeral 88 denotes threaded holes for receiving threaded bolts whilst the numeral 90 denotes slots for allowing for adjustment of structures received on the top of the planar web or to receive projections descending from structures received on the top of the planar web. On the underside of the planar web 82 is provided an array of reinforcing ribs 92 which reinforce the planar web 82 and the threaded holes 88 and slots 90. The array of reinforcing ribs 92 also reinforces central hole 94. The array of reinforcing ribs, planar web, tubes, and flanges are cast as one piece. This is aimed at achieving a reduced weight yet retaining satisfactory strength and rigidity for the footing plate.

Figure 13:
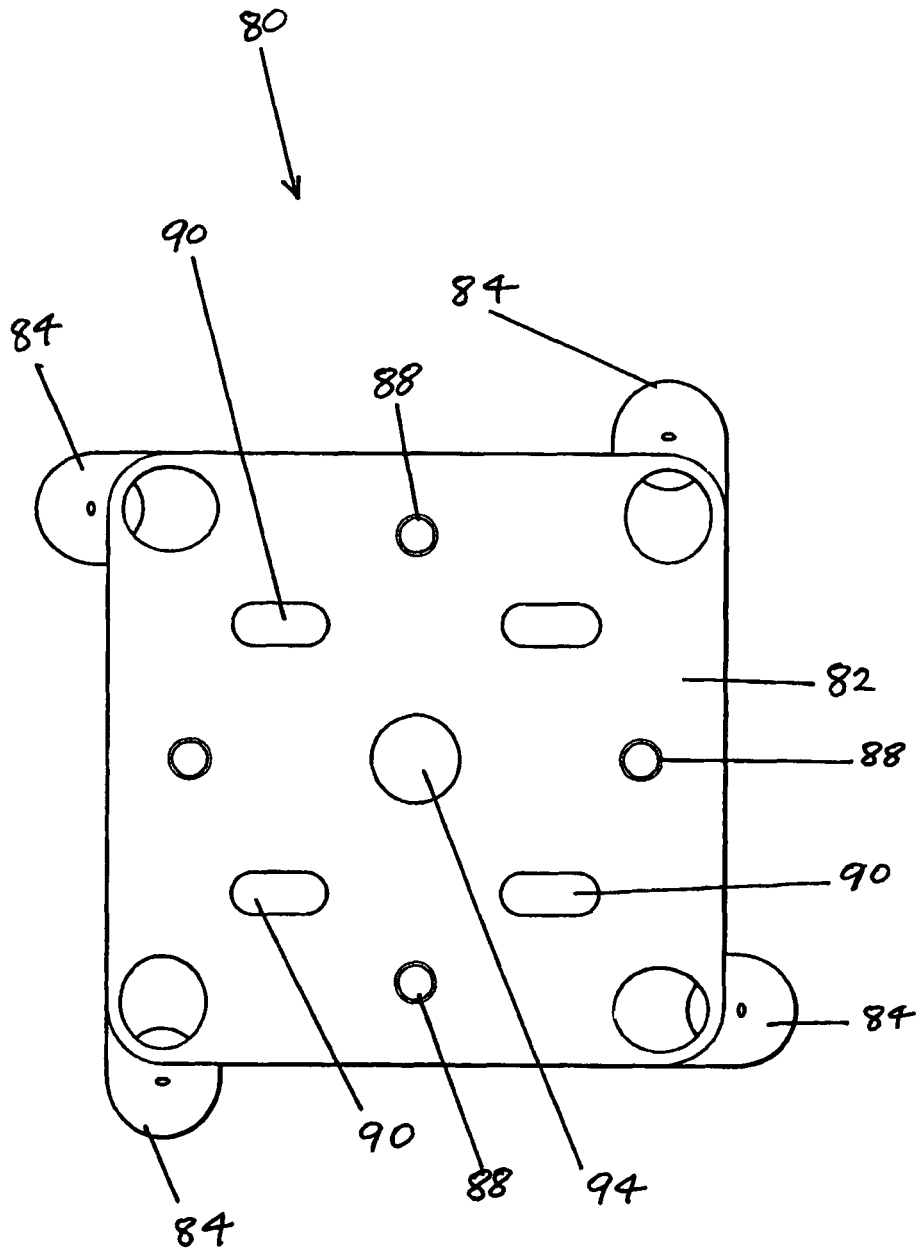
FIG. 13 is a plan view from above of the embodiment of FIG. 11.
Figure 14:
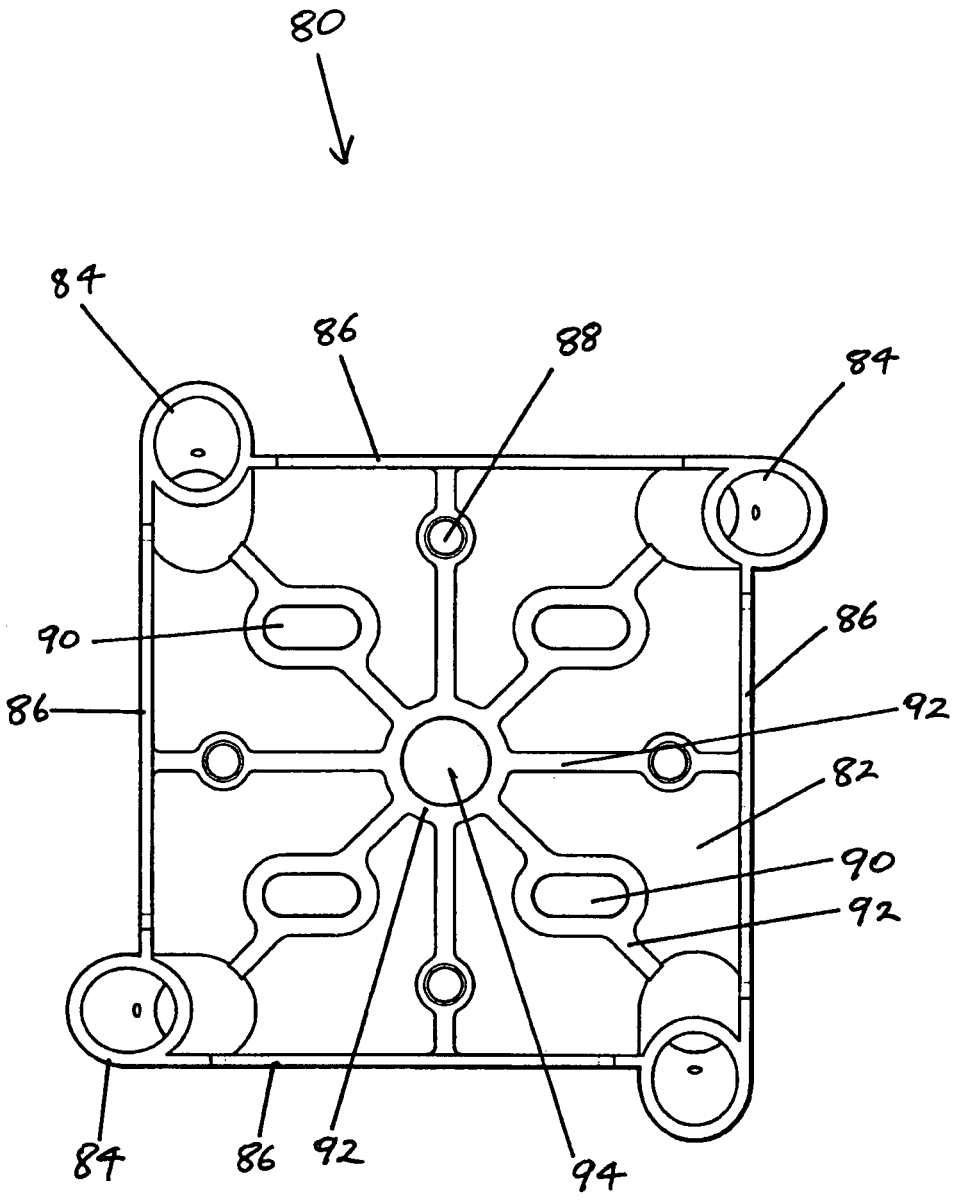
FIG. 14 is a plan view from below of the embodiment of FIGS. 11.
Figure 15:
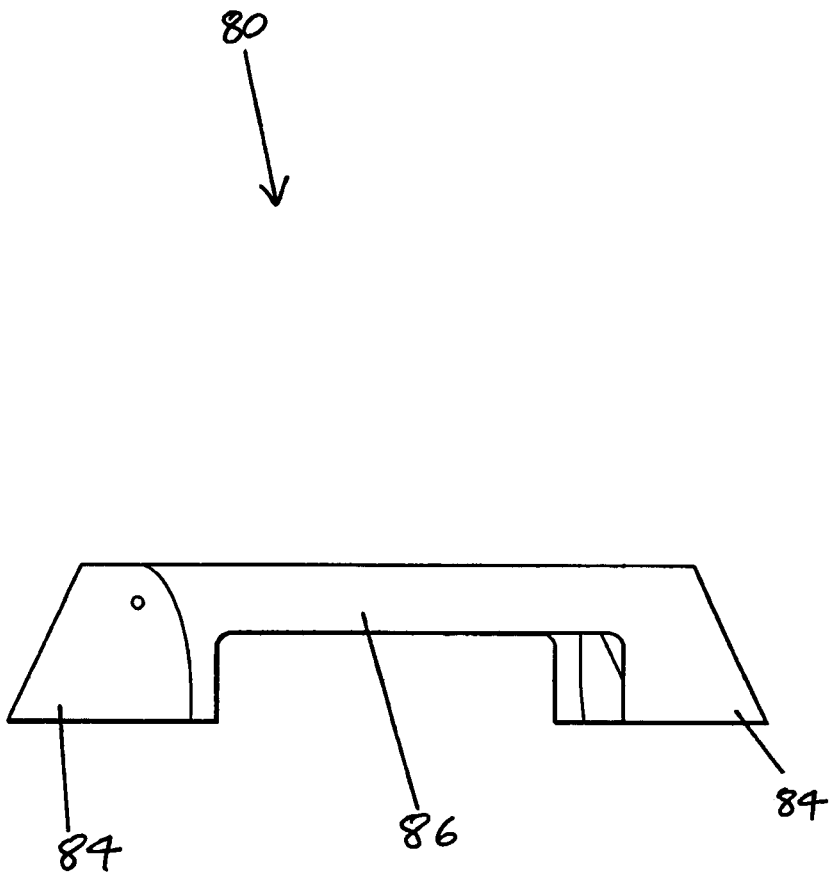
FIG. 15 is an elevational view of the embodiment of FIG. 11.

As can be seen from FIG. 13 the tubes 84 are inclined at an angle, not being 90°, to the planar web 82.

In use the third preferred embodiment may be used in the same manner as that described in relation to the first and second preferred embodiments.

It is to be understood that the invention may embrace many further modifications as would be readily apparent to persons skilled in the art and which would be deemed to reside within the broad scope and ambit of the invention. The preferred embodiments described above are by way of example only and are not to be considered as limiting.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form or suggestion that the prior art forms part of the common general knowledge in Australia.

The invention claimed is:

1. A footing plate comprising a planar web, the planar web having a plurality of tubes passing therethrough, the tubes being disposed upon a polygon circuiting the web, the polygon comprising straight section lines and vertices, at least one of the plurality of tubes is disposed on a straight section line of the polygon and having a tube axis that both forms an angle with the planar web when the planar web is considered in lateral view and is substantially parallel to the straight section line of the polygon upon which it is disposed when the planar web is considered in plan view, at least one of the plurality of tubes is disposed on a vertex of the polygon, said tubes being sized to permit the passage therethrough of pins for fixing into underlying ground, said planar web being provided with a flange extending downwardly from an edge of said planar web, the flange configured to contact the underlying ground, said planar web having on its upper surface a central region having a socket extending upwardly therefrom, the socket configured to receive a post, a pole or an upright structural member.

2. The footing plate of claim 1 wherein the polygon has four internal angles of 90 degrees each.

3. The footing plate of claim 1 wherein two of the plurality of tubes are disposed upon opposing lines of the polygon, and the tube axes are angled in opposite directions when the planar web is considered in lateral view.

4. The footing plate of claim 1 wherein two of the plurality of tubes are adjacent and have tube axes angled in opposite directions when the planar web is considered in lateral view.

5. The footing plate of claim 1 wherein no adjacent tubes of the plurality of tubes have tube axes angled in the same direction when the planar web is considered in lateral view.

6. The footing plate of claim 1 wherein a tube is disposed at each corner of the polygon, and/or a tube is disposed upon each straight line section of the polygon.

7. The footing of claim 1 wherein the tubes axes of adjacent tubes is rotated by 90 degrees when the footing plate is considered in plan view.

8. The footing of claim 1 wherein the line circuiting the planar web forms a polygon having four internal angles of 90 degrees each, and two of the plurality of tubes are disposed upon opposing lines of the polygon and two of the plurality of tubes are disposed adjacent to each other, and the two opposing tubes have tube axes angled in opposite directions, and the two adjacent tubes have tube axes angled in opposite directions, and no adjacent tubes have tube axes angled in the same direction, a tube is disposed at each corner of the polygon.

* * * * *